US007762412B2

(12) United States Patent
Porubcansky

(10) Patent No.: US 7,762,412 B2
(45) Date of Patent: Jul. 27, 2010

(54) MAST RAISING STRUCTURE AND PROCESS FOR HIGH-CAPACITY MOBILE LIFT CRANE

(75) Inventor: Kenneth J. Porubcansky, Whitelaw, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 166 days.

(21) Appl. No.: 11/740,726

(22) Filed: Apr. 26, 2007

(65) Prior Publication Data

US 2008/0264887 A1 Oct. 30, 2008

(51) Int. Cl.
*B66C 23/64* (2006.01)

(52) U.S. Cl. ..... 212/299; 212/237; 212/238; 212/260; 212/261; 212/270

(58) Field of Classification Search ..... 212/299, 212/260–261, 237–238, 270
See application file for complete search history.

(56) References Cited

U.S. PATENT DOCUMENTS 2,786,582 A * 3/1957 Foster ..... 212/181
2,813,636 A * 11/1957 Preston ..... 212/298
3,187,905 A * 6/1965 Moskopf et al. ..... 414/778

(Continued)

FOREIGN PATENT DOCUMENTS

DE 25 54 910 A1 * 6/1977

(Continued)

OTHER PUBLICATIONS

Pages from "Terex-Demag CC 8800—Assembling and Dismantling the Crane," Demag Mobile Cranes Gmbh & Co.KG, pp. 99-111 (undated but prior to Apr. 26, 2007).

(Continued)

*Primary Examiner*—Thomas J. Brahan
(74) *Attorney, Agent, or Firm*—Brinks Hofer Gilson & Lione; Steven P. Shurtz

(57) ABSTRACT

A mobile lift crane includes a carbody having moveable ground engaging members; a rotating bed rotatably connected to the carbody such that the rotating bed can swing with respect to the ground engaging members; a boom pivotally mounted on a front portion of the rotating bed and a mast mounted at its first end on the rotating bed and having a second end; and at least one hydraulic cylinder pivotally connected at a first end to the rotating bed. The hydraulic cylinder is positioned and configured so as to be able to raise the second end of the mast from the mast being in a near horizontal position to a position where the mast is used during crane pick, move and set operations. In a preferred embodiment, at least one arm is pivotally connected at a first end to the rotating bed and at a second end to the hydraulic cylinder. The arm and cylinder are connected together such that extension and retraction of a piston within the hydraulic cylinder causes the second end of the arm to raise and lower. The arm and cylinder support at least one mast-engaging member positioned such that raising the second end of the arm causes the mast-engaging member to push against and raise the mast when the mast is in a set-up state. Thus the hydraulic cylinder is used to pivotally rotate the mast about its connection to the rotating bed, thereby raising the second end of the mast.

27 Claims, 5 Drawing Sheets

U.S. PATENT DOCUMENTS

| | | | | | |
|---|---|---|---|---|---|
| 3,426,916 | A | * | 2/1969 | Novotny | 212/297 |
| 3,836,010 | A | | 9/1974 | Lampson | |
| 3,868,022 | A | | 2/1975 | Greenlay et al. | |
| 4,050,586 | A | * | 9/1977 | Morrow et al. | 212/298 |
| 4,170,309 | A | | 10/1979 | Lampson | |
| 4,212,404 | A | | 7/1980 | Campbell et al. | |
| 4,243,148 | A | | 1/1981 | Lampson | |
| 4,349,115 | A | | 9/1982 | Lampson | |
| 4,387,814 | A | | 6/1983 | Beduhn et al. | |
| 4,508,232 | A | | 4/1985 | Lampson | |
| 4,537,317 | A | | 8/1985 | Jensen | |
| 4,579,234 | A | | 4/1986 | Delago et al. | |
| 4,711,358 | A | * | 12/1987 | Konishi | 212/178 |
| 4,863,004 | A | | 9/1989 | Kummer et al. | |
| 5,240,129 | A | * | 8/1993 | Schrick et al. | 212/175 |
| 5,615,784 | A | * | 4/1997 | Pech et al. | 212/178 |
| 6,089,388 | A | | 7/2000 | Willim | |
| 6,588,521 | B1 | * | 7/2003 | Porubcansky et al. | 180/9.1 |
| 6,695,158 | B2 | * | 2/2004 | Taylor et al. | 212/298 |
| 6,871,427 | B2 | * | 3/2005 | Muta et al. | 37/466 |

FOREIGN PATENT DOCUMENTS

| | | | | |
|---|---|---|---|---|
| DE | 38 38 975 | A1 | * | 5/1990 |
| EP | 0 588 516 | A1 | | 3/1994 |
| EP | 0 945 393 | A2 | * | 9/1999 |
| JP | 9-58980 | A | * | 3/1997 |
| JP | 9-165192 | A | * | 6/1997 |
| JP | 2000-126829 | | * | 11/2001 |
| JP | 2003-182980 | A | * | 7/2003 |
| JP | 2003-327389 | A | * | 11/2003 |

OTHER PUBLICATIONS

Brochure, "Lampson Products and Capabilities," 13 pages (undated but prior to Apr. 26, 2007).
"LR 11350 Raupenkran Crawler Crane—Technical Data," Liebherr, cover page and pp. 6-8 (undated but prior to Apr. 26, 2007).
"Model 21000 Product Guide," Manitowoc, 44 pages (2000).

* cited by examiner

MAST RAISING STRUCTURE AND PROCESS FOR HIGH-CAPACITY MOBILE LIFT CRANE

BACKGROUND

The present application relates to lift cranes, and particularly to high-capacity mobile lift cranes having a mast behind the main boom from which counterweight is supported, and to methods of raising that mast during a set-up operation.

High-capacity mobile lift cranes typically include a carbody having moveable ground engaging members; a rotating bed rotatably connected to the carbody such that the rotating bed can swing with respect to the ground engaging members; a boom pivotally mounted on a front portion of the rotating bed, with a hoist line extending therefrom; a mast mounted on the rotating bed; and counterweight to help balance the crane when the crane lifts a load. The mast is used to support the rigging, including the boom hoist rigging, so that it may transfer the forces from lifting a load to the rear of the carbody and the counterweight. Sometimes an extra counterweight attachment, such as a counterweight trailer, is added to the crane to further enhance the lift capacity of the mobile lift crane. Since the load is often moved in and out with respect to the center of rotation of the crane, and thus generates different moments throughout a crane pick, move and set operation, it is advantageous if the counterweight, including any extra counterweight attachments, can also be moved forward and backward with respect to the center of rotation of the crane. In this way a smaller amount of counterweight can be utilized than would be necessary if the counterweight had to be kept at a fixed distance. The mast has to be designed to support the rigging, including a tension member, such as a counterweight strap, tied to such counterweights. The mast for such high-capacity cranes is usually made from a plurality of lattice segments and is designed to withstand very substantial compressive loads.

Since the crane will be used in various locations, it needs to be designed so that it can be transported from one job site to the next. This usually requires that the crane be dismantled into components that are of a size and weight that they can be transported by truck within highway transportation limits. Thus, any weight reductions that can be achieved with the design of the crane help with not only its initial cost, but with the cost of transporting it between jobs for the life of the crane. Further, the ease with which the crane can be dismantled and set up, and the need for assist cranes to do that, has an impact on the total cost of using the crane. Thus, to the extent that fewer man-hours are needed to set up the crane, including the man-hours needed to set up an assist crane, there is a direct advantage to the crane owner.

Most high-capacity cranes are set up with the mast, which is first assembled from segments on the ground, being lifted by an assist crane and attached to the rotating bed. Typically the mast is positioned so that it extends out over the front of the crane. Rigging connected to a gantry on the rear of the crane is then used to pull the mast into an upright position. Since it will eventually be positioned so as to lean backwards, it has to be pulled over a vertical position. Of course at this point the mast will start to fall. Thus there must be tension applied to the mast from the front as it passes over center to prevent it from falling. This is usually provided by a hold-back assist crane, or the boom hoist rigging is installed and attached to the boom to provide a counter force. When the boom hoist rigging is used, the crane set-up operator has to be very skillful so as to draw rope on the mast hoist spools while simultaneously paying out rope for the boom hoist rigging so as to controllably bring the mast to its working position.

Some high-capacity cranes are even more complicated, such as the Liebherr LR11350, using a derrick mast as well as a moving machine mast, the derrick mast being moveable as the extra counterweight unit is moved in and out. This derrick mast is assembled in the same way the main mast described above is added to the crane, requiring the derrick mast to be pulled over top center from its initial over-the-front position.

In addition to the fact that the lift enhancing mast is installed and raised from an over-the-front position, requiring highly skilled crane operators in the set up of the crane, the structure needed to raise the mast is also substantial. The cranes need a structure, either a gantry or moving mast, to provide a moment arm about the mast hinge pin. There must also be a powered drum, rope, associated sheaves, multipart reeving and mast raising hardware. As mentioned above, there must also be a means to hold the mast back as it approaches the over-center position and then is controllably brought to its working position.

U.S. Pat. No. 4,349,115 to Lampson discloses a crane that has a mobile counterweight unit separate from the main crane carbody. A mast is used on this crane as with other high-capacity mobile cranes. The Lampson patent discloses a set-up operation wherein the mast is first attached to the rotating bed and extends backwards over the rear of the crane. The mast is attached at its outer end to a counterweight strut, which in turn is attached to the mobile counterweight unit. These are assembled near ground level. An assist crane is used to raise the connection at the mast and the counterweight strut to near its working height, at which time the counterweight unit can be brought close enough to the rotating bed that a spreader link can be connected between the rotating bed and the mobile counterweight unit. While this set-up operation avoids the need for a gantry, powered drum, sheaves and reeving, it still requires an assist crane that has the capacity to raise not only the mast, but the counterweight strut as well, and to lift them up to a height where the boom hoist rigging and weight of the boom can act as a counterweight to pull the mast up to its final working position. The assist crane must have a fairly long boom to accomplish this.

Thus there is a need for further improvements in high-capacity mobile lift cranes, particularly in the structure and procedure used to raise the mast.

BRIEF SUMMARY

A mobile lift crane and method of set up have been invented which use a linear actuation device on the rotating bed to raise the mast. In a first aspect, the invention is a mobile lift crane comprising a carbody having moveable ground engaging members; a rotating bed rotatably connected to the carbody such that the rotating bed can swing with respect to the ground engaging members; a boom pivotally mounted on a front portion of the rotating bed; a mast mounted at its first end on the rotating bed and having a second end; and at least one linear actuation device pivotally connected at a first end to the rotating bed; the linear actuation device being positioned and configured so as to be able to raise the second end of the mast from the mast being in a near horizontal position to a position where the mast is used during crane pick, move and set operations.

In a second aspect, the invention is a method of setting up a mobile lift crane, the lift crane comprising, when set up, a carbody having moveable ground engaging members; a rotating bed rotatably connected to the carbody such that the rotating bed can swing with respect to the ground engaging members; a boom pivotally mounted on a front portion of the rotating bed, with a hoist line extending there from; a mast mounted at its first end on the rotating bed and having a second end opposite the first end; the method comprising connecting the mast to the rotating bed and positioning the mast so that it extends rearwardly over the rotating bed; and utilizing a linear actuation device also connected to the rotating bed to pivotally rotate the mast about its connection to the rotating bed, thereby raising the second end of the mast.

A third aspect of the invention is a method of setting up a mobile lift crane, comprising providing a carbody having moveable ground engaging members, a rotating bed rotatably connected to the carbody such that the rotating bed can swing with respect to the ground engaging members, and at least one linear actuation device; pivotably securing a mast at a first end thereof to the rotating bed; pivotably securing a backhitch to the mast at a position distant to the first end of the mast; using the linear actuation device to rotate the mast so as to lift the mast and backhitch; and connecting the backhitch to the rotating bed so as to support the mast in an upright position.

With the preferred embodiment of the present invention, there is no need for a separate gantry to provide a moment arm to raise the mast, nor for the powered drum, sheaves, reeving and other hardware used when a mast is pulled up from out in front of the crane. Nor is there a need for a hold back assist crane, or to use the boom as counterweight and go through a complicated operation of taking up mast raising rope while paying out boom hoist rigging. Further, an assist crane is not needed to raise the mast to a high angle while it is attached to a counterweight strut. Also, in the preferred embodiment, the linear actuation device used to raise the mast may also later be used during crane operation to move a large counterweight toward and away from the rotating bed so as to provide varying counterweight moments. Further details of the counterweight movement structure and its advantages are described in U.S. patent application Ser. No. 11/733,104, filed Apr. 9, 2007, which is hereby incorporated by reference in its entirety.

These and other advantages of the invention, as well as the invention itself, will be more easily understood in view of the attached drawings.

DETAILED DESCRIPTION OF THE DRAWINGS AND THE PRESENTLY PREFERRED EMBODIMENTS

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Several terms used in herein have a meaning defined as follows.

The front of the rotating bed is defined as the portion of the rotating bed that is between the axis of rotation of the rotating bed and the position of the load when a load is being lifted. The rear portion of the rotating bed includes everything opposite the axis of rotation from the front of the rotating bed. The terms "front" and "rear" (or modifications thereof such as "rearward") referring to other parts of the rotating bed, or things connected thereto, such as the mast, are taken from this same context, regardless of the actual position of the rotating bed with respect to the ground engaging members.

The position of the counterweight unit is defined as the center of gravity of the combination of all counterweight elements and any holding tray to which the counterweights are attached, or otherwise move in conjunction with. All counterweight units on a crane that are tied together so as to always move simultaneously are treated as a single counterweight for purposes of determining the center of gravity.

The top of the mast is defined as the furthest back position on the mast from which any line or tension member supported from the mast is suspended. If no line or tension member is supported from the mast, then the top of the mast is the position to which any backhitch is attached.

The moveable ground engaging members are defined as members that are designed to remain engaged with the ground while the crane moves over the ground, such as tires or crawlers, but does not include ground engaging members that are designed to be stationary with respect to the ground, or be lifted from contact with the ground when they are moved, such as a ring on a ring supported crane.

The term "move" when referring to a crane operation includes movement of the crane with respect to the ground. This can be either a travel operation, where the crane traverses a distance over the ground on its ground engaging members; a swing operation, in which the rotating bed rotates with respect to the ground; or combinations of travel and swing operations.

Figure 1:
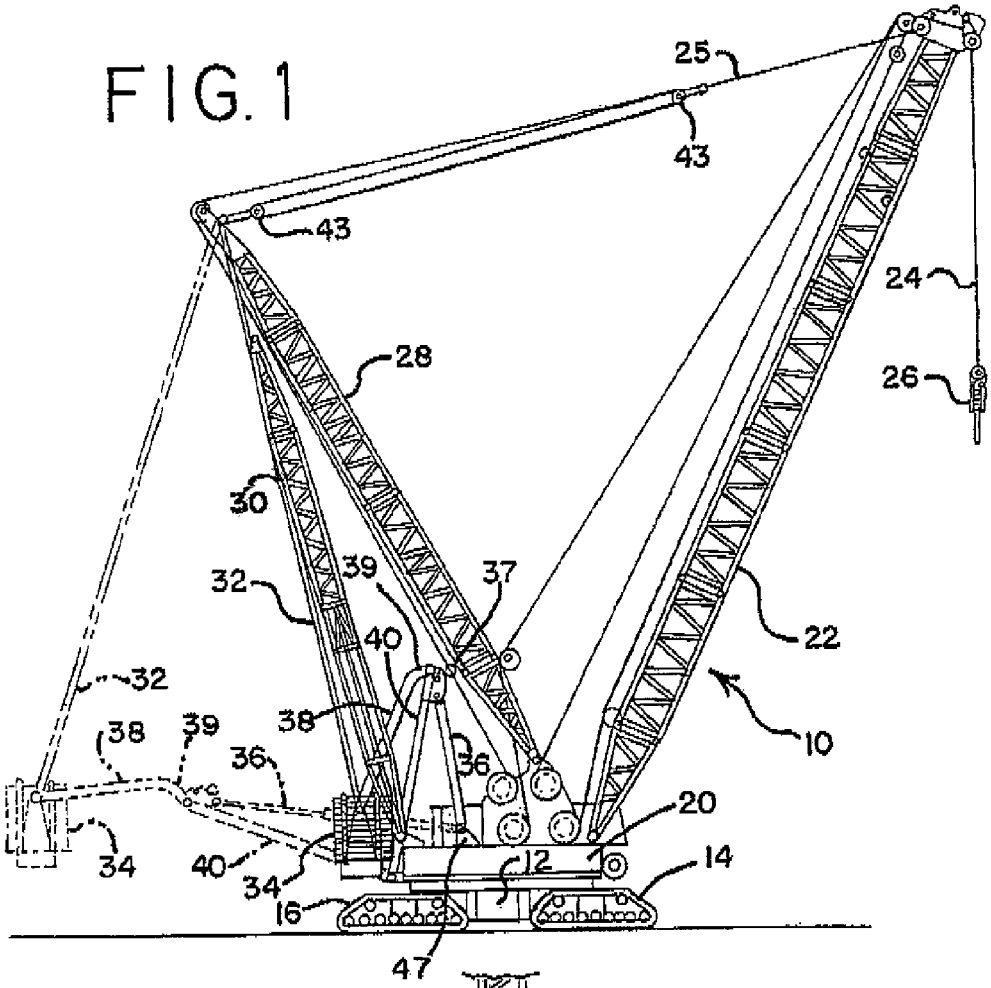
FIG. 1 is a side elevational view of a first embodiment of a mobile lift crane with a variable position counterweight, shown with the counterweight in a far forward position in solid lines and showing the counterweight in a second position with dashed lines.
Figure 2:
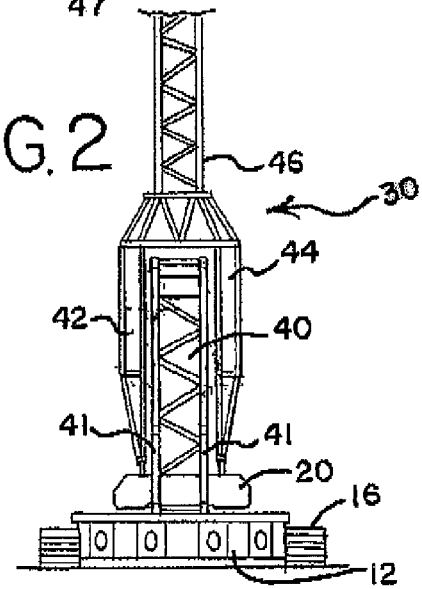
FIG. 2 is a partial rear elevational view of the crane of FIG. 1.

In the first embodiment, shown in FIGS. 1-10, and particularly in FIGS. 1 and 2, the mobile lift crane 10 includes lower works, also referred to as a carbody 12, and moveable ground engaging members in the form of crawlers 14 and 16. (There are of course two front crawlers 14 and two rear crawlers 16, only one each of which can be seen from the side view of FIG. 1. The other rear crawler can be seen in the rear view of FIG. 2.) (FIG. 2 is simplified for sake of clarity, and does not show the boom, mast and counterweight unit.) In the crane 10, the ground engaging members could be just one set of crawlers, one crawler on each side. Of course additional crawlers than those shown, or other ground engaging members such as tires, can be used.

A rotating bed 20 is rotatably connected to the carbody 12 such that the rotating bed can swing with respect to the ground engaging members. The rotating bed is mounted to the carbody 12 with rollers running on a roller path, such that the rotating bed 20 can swing about an axis with respect to the carbody, and hence with respect to the ground engaging members 14, 16. The rotating bed usually includes a weldment and additional components, such as the boom hoist and load drums, attached to the weldment. All of these attachments that rotate with the weldment are considered as the rotating bed. The rotating bed supports a boom 22 pivotally mounted on a front portion of the rotating bed; a mast 28 mounted at its first end on the rotating bed; a backhitch 30 connected between the mast and a rear portion of the rotating bed; and a moveable counterweight unit 34 having counterweights on a support member or tray. The counterweights may be in the form of multiple stacks of individual counterweight members on the support member 33.

Boom hoist rigging 25 between the top of mast 28 and boom 22 is used to control the boom angle and transfers load so that the counterweight can be used to balance a load lifted by the crane. A hoist line 24 extends from the boom 22, supporting a hook 26. The rotating bed 20 may also includes other elements commonly found on a mobile lift crane, such as an operator's cab and hoist drums for the rigging 25 and hoist line 24. If desired, the boom 22 may comprise a luffing jib pivotally mounted to the top of the main boom, or other boom configurations. The backhitch 30 is connected adjacent the top of the mast 28. The backhitch 30 may comprise a lattice member designed to carry both compression and tension loads as shown in FIG. 1. In the crane 10, the mast is held at a fixed angle with respect to the rotating bed during crane operations, such as a pick, move and set operation.

The counterweight unit is moveable with respect to the rest of the rotating bed 20. A tension member, such as a counterweight strap 32, connected adjacent the top of the mast supports the counterweight unit in a suspended mode. A counterweight movement structure is connected between the rotating bed and the counterweight unit such that the counterweight unit may be moved to and held at a first position in front of the top of the mast, and moved to and held at a second position rearward of the top of the mast. At least one hydraulic cylinder 36, which acts as a linear actuation device, and at least one arm pivotally connected at a first end to the rotating bed and at a second end to the hydraulic cylinder are used in the counterweight movement structure of crane 10 to change the position of the counterweight. The arm and hydraulic cylinder are connected between the rotating bed and the counterweight unit such that extension and retraction of the hydraulic cylinder changes the position of the counterweight unit compared to the rotating bed. The dashed lines in FIG. 1 show the counterweight in an extended position.

In the crane 10, the at least one arm preferably comprises a pivot frame 40 and a rear arm 38. (As with the crawlers, the rear arm 38 actually has both left and right members, only one of which can be seen in FIG. 1. The hydraulic cylinder may comprise two cylinders that move in tandem, or may be a single cylinder attached to the top center of the pivot frame. However, the following discussion only refers to one cylinder 36 and one arm 38 for sake of simplicity. Also, FIG. 2 does not show the arms 38 and cylinders 36 for sake of clarity.) The pivot frame 40 is connected between the rotating bed 20 and hydraulic cylinder 36, and the rear arm 38 is connected between the pivot frame 40 and the counterweight unit 34

The hydraulic cylinder 36 is pivotally connected to the rotating bed 20 on a support frame 47 which elevates the hydraulic cylinder 36 to a point so that the geometry of the cylinder 36, pivot frame 40 and rear arm 38 can move the counterweight through its entire range of motion. In this manner the cylinder 36 causes the rear arm 38 to move the counterweight unit when the cylinder is retracted and extended.

Arm 38 is not straight, but rather has an angled portion 39 at the end that connects to the pivot frame 40. This allows the arm 38 to connect directly in line with the side members 41 (FIG. 2) of pivot frame 40. The angled portion 39 prevents the arm 38 from interfering with the side members 41 of the pivot frame when the counterweight is in the position shown in solid lines in FIG. 1.

In crane 10 the rotating bed is short, and hence the point on the rotating bed where the backhitch 30 is connected is forward of the point where the mast and backhitch connect, which causes the backhitch to be at an angle from the axis of rotation of the rotating bed. This angle may be between about 10° and about 20°. The preferred angle is about 16°. Further, while the backhitch 30 and tension member 32 are not connected at the very top of the mast 28, they are both still connected adjacent the top of the mast.

Also, as best seen in FIG. 2, the backhitch 30 has an A-frame configuration, with two spaced apart legs 42 and 44 and a central upstanding member 46. The legs 42 and 44 are spaced apart so that arms 38 and pivot frame 40 can fit between legs 42 and 44 of the backhitch 30 as the counterweight unit 34 swings outwardly. The counterweight unit 34 can be moved between a far forward position, when the hydraulic cylinder 36 is fully retracted, to a far rearward position (shown in dashed lines) when the cylinder 36 is fully extended. The A-frame structure permits the backhitch to be connected up closer to the centerline of rotation of the crane 10 without interfering with the movement of the pivot frame 40 and arms 38. Having the backhitch connect at this closer position allows for the rotating bed to be shortened compared to other crane designs. Other embodiments of a high-capacity mobile lift crane with a move able counterweight on which the present invention may also be used are shown in application Ser. No. 11/733,104, referred to above.

Figure 3:
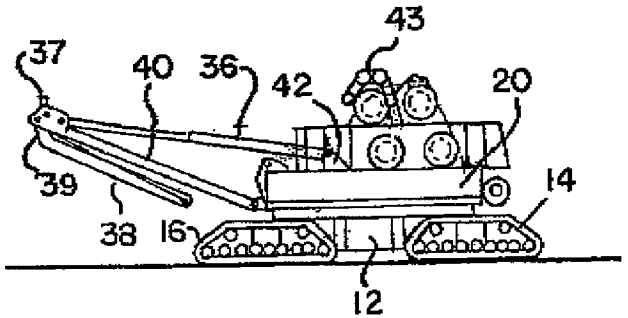
FIG. 3 is a side elevational view of the carbody, rotating bed and crawlers of the crane of FIG. 1 shown at a first stage of set up, with the counterweight frame assembly in place.

The set-up operation for the crane and the preferred embodiment of the mast raising structure will now be explained. FIG. 3 shows the carbody 12 assembled with the ground engaging crawlers 14 and 16 already assembled with the rotating bed 20 in a first stage of set up. The counterweight movement frame assembly is also attached, including the pivot frame 40, the hydraulic cylinder 36 and rear arm 38. This constitutes a base unit, assembled and ready to accept the mast. An equalizer assembly 43, which forms part of the boom hoist rigging 25, is positioned on the rotating bed, shown in FIG. 3 in its transport position.

Figure 4:
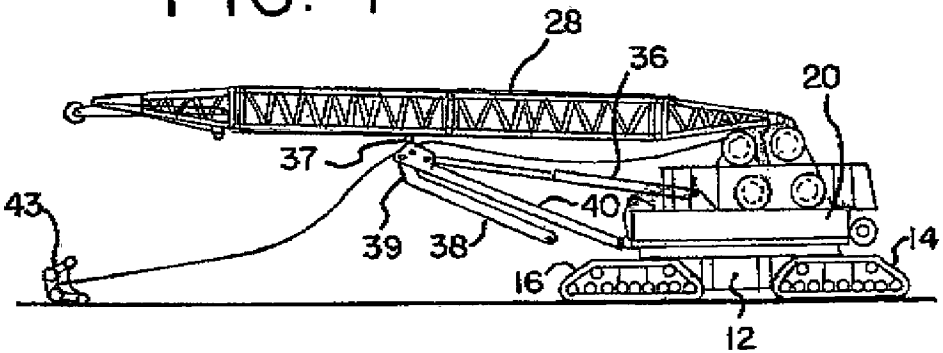
FIG. 4 is a side elevational view of the structure of FIG. 3 with the mast attached in a second stage of set up.

FIG. 4 shows the base assembly in the next set-up stage. In this stage, the equalizer assembly 43 has been pulled from off of the rotating bed and placed on the ground. The mast 28, which was assembled from segments on the ground, has been lifted into place by an assist crane, and the pin which forms the mast hinge has been hydraulically inserted to pivotally secure the mast 28 to the rotating bed 20. The mast 28 extends rearwardly over the back of the rotating bed in a nearly horizontal position. A mast raising roller 37 located on the counterweight movement structure where the cylinder 36, pivot frame 40 and rear arm 38 all connect, acts as a mast-engaging member, and contacts the underside of the mast. (As with other components in the counterweight movement structure, there are two rollers 37, although only one can be seen from the side view of FIG. 1.)

Figure 5:
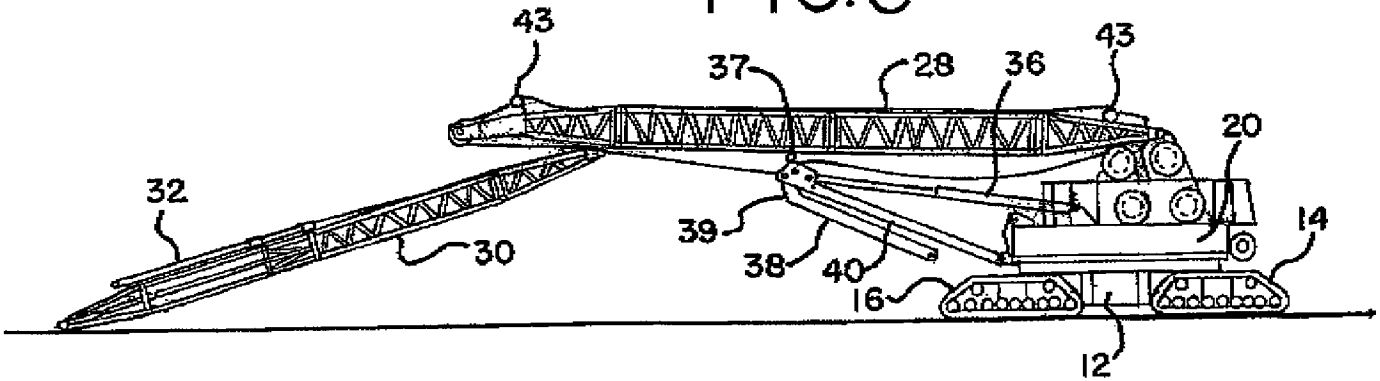
FIG. 5 is a side elevational view of the structure of FIG. 4 with the backhitch attached in a third stage of set up.

Step three of the set-up process is depicted in FIG. 5. The equalizer assembly 43 is now separated and attached to the mast top and mast butt. The backhitch 30, first assembled on the ground from sections, is lifted into position by an assist crane and pinned to the mast adjacent the top of the mast. The counterweight strap 32 is also connected to the top of the mast, and rests on the backhitch as it is raised into place. The roller 37, pivot frame 40 and cylinder 36 continue to support the mast, and part of the weight of the backhitch 30.

Figure 6:
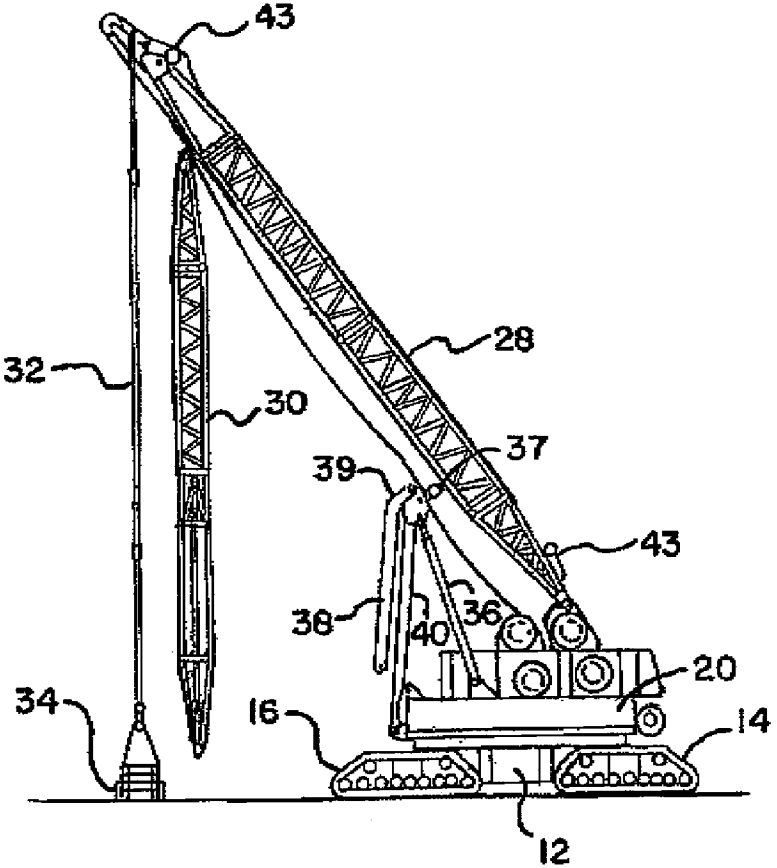
FIG. 6 is a side elevational view of the structure of FIG. 5 with the counterweight unit and strap attached, and the mast raised, in a fourth stage of set up.

FIG. 6 shows the next stage of the set up. The hydraulic cylinder 36 has been retracted, which draws the pivot frame 40 toward the front of the rotating bed 20. In doing so, the mast raising roller 37 has pushed upwardly and rolled along the underside of the mast, raising the mast 28 to the position shown in FIG. 6. The backhitch may be outfitted with ground-engaging rollers to help it move as the mast is raised. The backhitch 30 and counterweight strap 32 are now suspended from the mast 28. The counterweight unit 34 is positioned with an assist crane. The counterweight tension member 32 is hydraulically pinned to an A-frame on the counterweight support member or tray while the tray rests on the ground.

Figure 7:
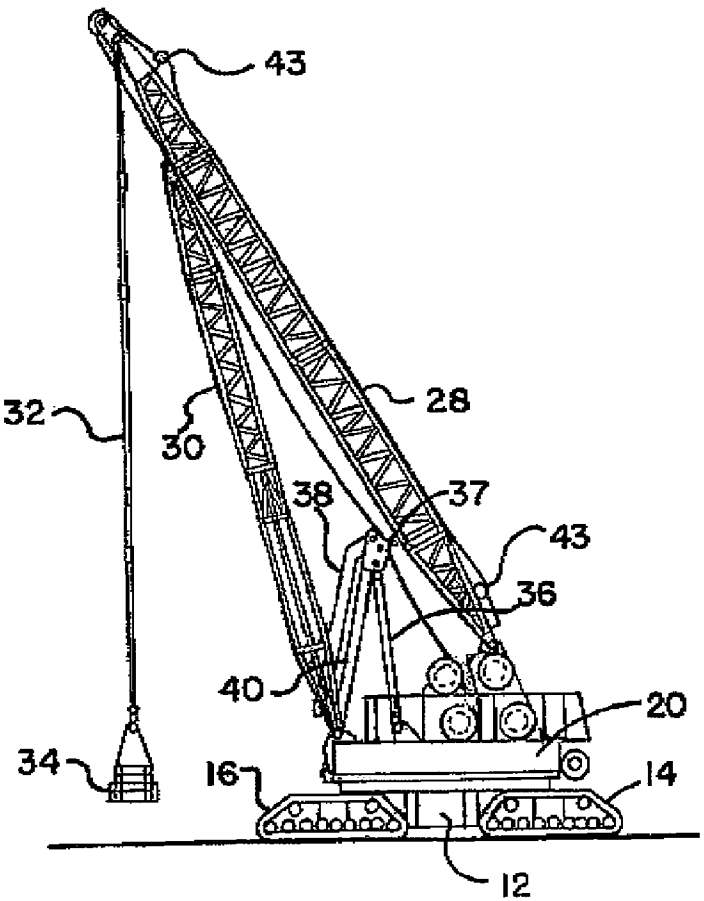
FIG. 7 is a side elevational view of the structure of FIG. 6 with the backhitch attached to the rotating bed in a fifth stage of set up.

In the next stage of set up, shown in FIG. 7, the cylinder 36 is further retracted, causing the roller 37 to raise the mast 28 to its working position, and also raising the counterweight unit 34 off the ground. A rigging winch line is attached to the backhitch and the bottom of the backhitch 30 is pulled toward the rotating bed 20. The backhitch is then hydraulically pinned to the rear of the rotating bed at the rear house roller carrier beam. From this Figure it can bee seen that the cylinder is positioned and configured so as to be able to raise the second end of the mast from the mast being in a near horizontal position (FIG. 4) to a position where the mast is used during crane pick, move and set operations (FIG. 7).

Figure 9:
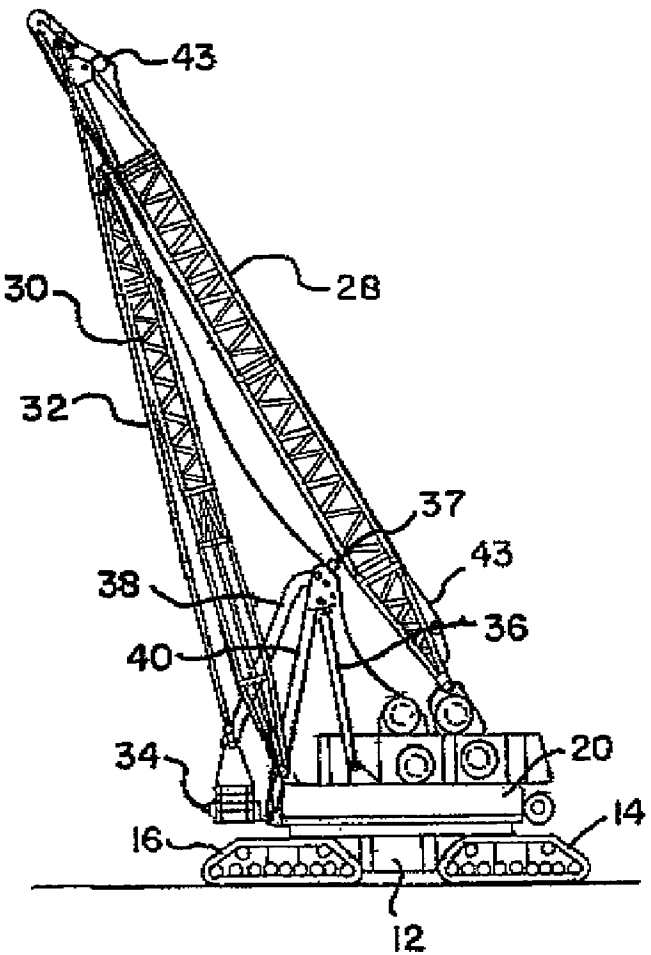
FIG. 9 is a side elevational view of the structure of FIG. 8 in a seventh stage of set up.
Figure 8:
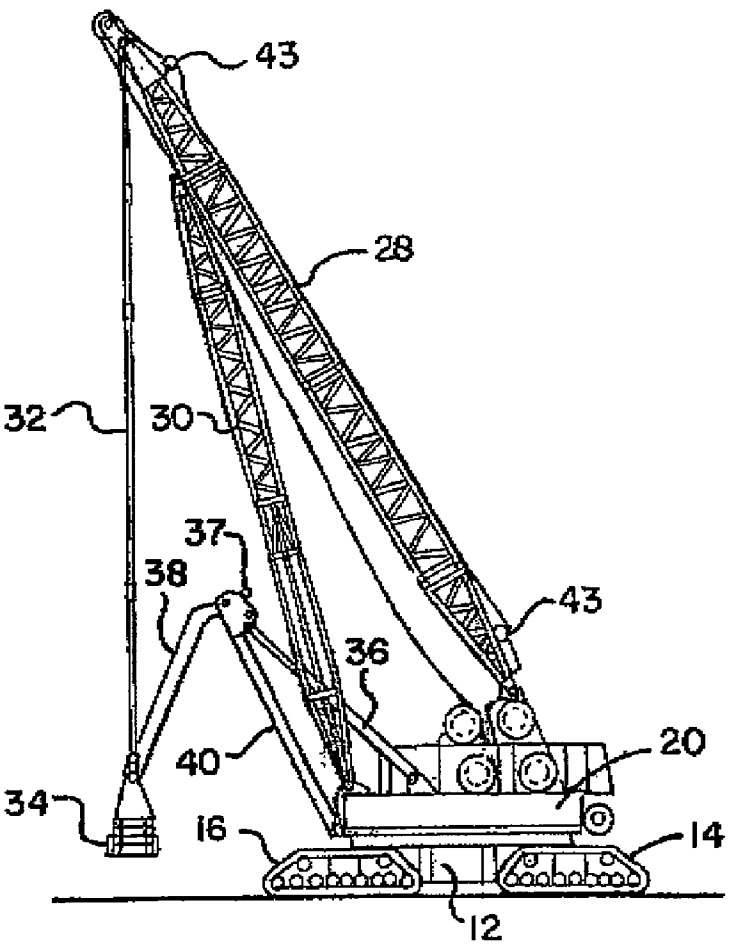
FIG. 8 is a side elevational view of the structure of FIG. 7 with the rear arm attached to the counterweight in a sixth stage of set up.

With the backhitch 30 in place, the mast 28 is now supported by the backhitch, and the roller 37 is no longer needed. FIG. 8 shows the next stage of set up, where the cylinder 36 is now extended, swinging the pivot frame 40 backward. An assist crane then pulls the rear arm 38 to where it can be hydraulically pinned to the A-frame on the counterweight unit 34. Thereafter the cylinder 36, pivot frame 40 and rear arm 38 act as a counterweight movement structure, allowing the counterweight unit 34 to be moved towards and away from the rotating bed 20. In FIG. 9 the cylinder is retracted until the counterweight unit is pulled in to its far forward position.

Figure 10:
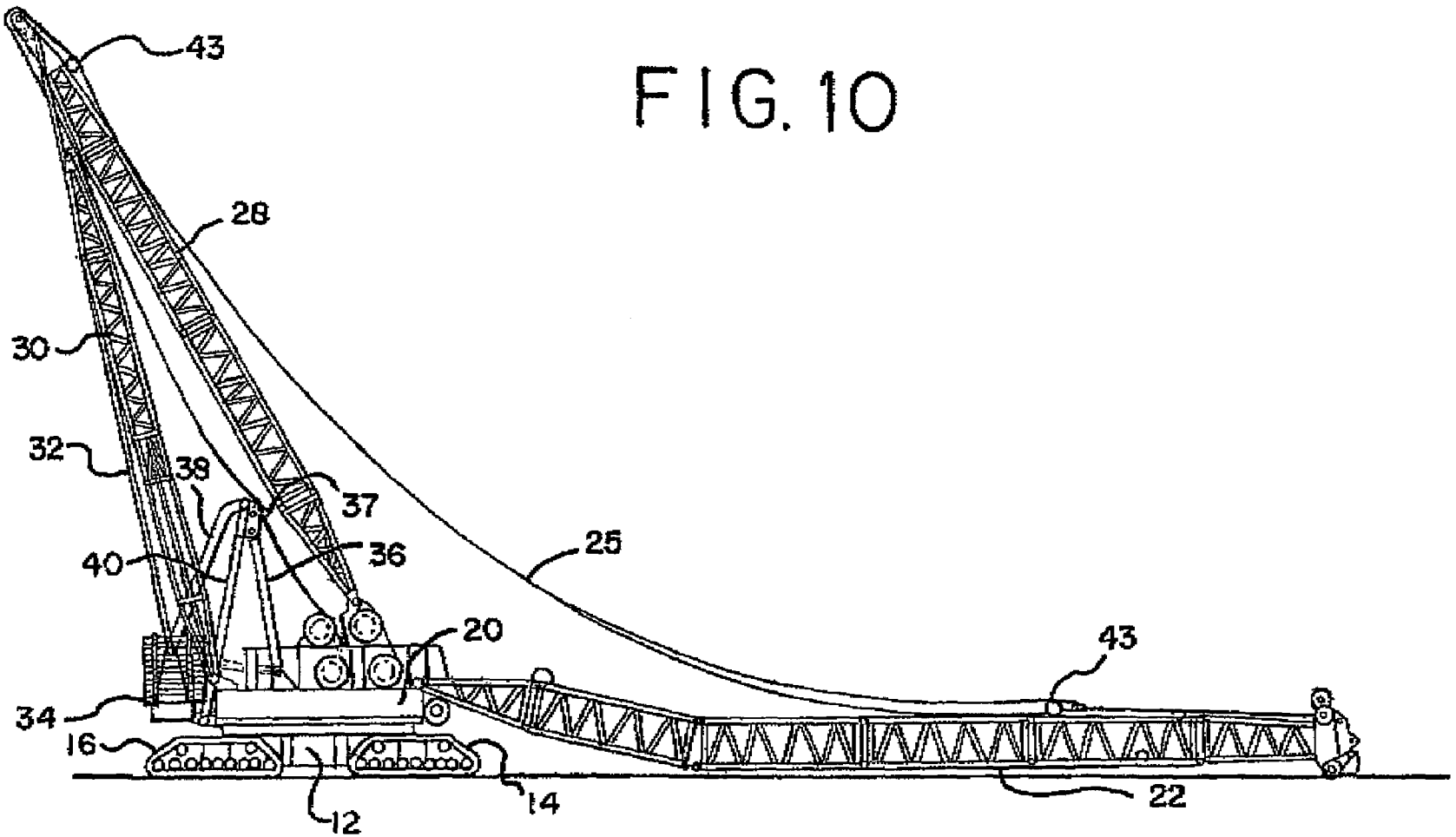
FIG. 10 is a side elevational view of the structure of FIG. 9 with the boom attached in an eighth stage of set up.

FIG. 10 shows the crane 10 in one of its final set-up stages. The boom 22 is assembled on the ground. The boom butt and first section of the boom are lifted by an assist crane and attached to the rotating bed 20. The boom end of the equalizer assembly 43 is attached to the top of the boom 22. Additional pieces of counterweight are added to the counterweight unit. An assist crane must be used to lift the second section of the boom up to where all of the sections of the boom can be connected. Thereafter the boom hoist rigging 25 can be used to raise the boom to its operational position, shown in FIG. 1.

With the preferred embodiments of the invention, the mast can be raised without the need of any gantry and mast raising rigging as used in other models of cranes, such as the Liebherr LR11350. There is no need for a skilled operator to have to raise the mast over a top-center position, paying out boom hoist rigging while drawing in the mast raising rope. Further, while an assist crane is used in the above described embodiment, the assist crane does not need to lift the far end of the mast to near its working height, while a counterweight strut is attached to it, as in the crane disclosed in the Lampson patent. Thus the assist crane can use a much shorter boom.

The structure that is used to raise the mast has a dual function, and moves the counterweight unit in and out during normal crane operations. This counterweight movement mechanism has several advantages in itself, and the fact that in the preferred embodiment the same hydraulic cylinder can be used for two separate functions makes this structure even more economical The counterweight movement structure will generally be able to move the counterweight over a distance of at least 10 meters, and preferably at least 20 meters, depending on the crane size. In the embodiment of crane 10, the hydraulic cylinder 36 will preferably have a stroke of at least 5 meters. For the geometry shown, this results in the center of gravity of the counterweight unit being able to be moved to a distance of more than 28 meters (90 feet) from the center of rotation of the rotating bed. With the configuration of FIG. 1, the counterweight can be moved to a position within about 6 meters of the axis of rotation and to a position of at least 28 meters away from the axis of rotation. When the counterweight unit is suspended from the top of the mast, as it is in the embodiments shown in the figures, the counterweight movement structure can move and hold the counterweight at a position forward of the top of the mast such that the tension member is at an angle of over 5° compared to the axis of rotation, preferably over 10°, and more preferably over 13°. When the counterweight is at a position rearward of the top of the mast, the tension member is at an angle of at least 5°, preferably at least 10°, and more preferably over 15° compared the axis of rotation.

If desired, the extension of the cylinder 36 can be controlled by a computer to move the counterweight unit automatically to a position needed to counterbalance a load being lifted, or in a luffing operation. In such cases, a pin-style load cell may be used to sense the load in the backhitch, and move the counterweight to a point where that the load is at a desired level. If desired, the counterweight unit position can be infinitely variable between any position within the range permitted by complete retraction and complete extension of the cylinder 36. The variable positioning system self compensates for the required load moment. In other words, if partial counterweight is installed, the counterweight will automatically be positioned farther back to offset the required load moment. Only when the maximum rearward position is reached will the crane's capacity be reduced.

Elimination of the gantry, or moving mast, and hardware required to raise the mast from an over-the-front position results in a very significant manufacturing cost reduction for a crane constructed according to the preferred embodiment of the invention. Also, set up of the crane is easier. By eliminating the mast going over center, the operator skill required to controllably bring the mast to its working position is no longer necessary. Even though an assist crane is used, the boom needed for the assist crane can be relatively short. The preferred method described above also accommodates a rigid backhitch structure, which is required to handle compression loads generated with some operations of the variable position counterweight. The over-the-rear system allows for the counterweight to be easily pinned to the tension strap and also to the counterweight positioning arms.

It should be understood that various changes and modifications to the presently preferred embodiments described herein will be apparent to those skilled in the art. For example, the linear actuation device could simply be pinned to the mast when it is used to raise the mast. In that embodiment, the pivot frame 40 would not be used during the mast raising operation. The cylinder could stay pinned to the mast or be disconnected and stowed after the mast was raised and the backhitch connected to the rotating bed. In that embodiment, the cylinder would not be used to move the counterweight. Alternatively, after being used to raise the mast, the cylinder could be attached to a pivot frame and then used as described above to move the counterweight.

The mast-engaging member could be a sliding pad rather than roller 37. A slewing ring could be used instead of the rollers running on a roller path to allow the rotating bed to swing relative to the carbody. The cylinders, rear arms and pivot frames can be interconnected differently than shown in the drawings and still be connected between the rotating bed and counterweight unit to produce the desired movement of the counterweight unit and to raise the mast. Further, parts of the crane need not always be directly connected together as shown in the drawings. For example, the tension member could be connected to the mast by being connected to the backhitch near where the backhitch is connected to the mast. Such changes and modifications can be made without departing from the spirit and scope of the present invention and without diminishing its intended advantages. It is therefore intended that such changes and modifications be covered by the appended claims.

The invention claimed is:

1. A method of setting up a mobile lift crane, the lift crane comprising, when set up, a carbody having moveable ground engaging members; a rotating bed rotatably connected to the carbody such that the rotating bed can swing with respect to the ground engaging members; a boom pivotally mounted on a front portion of the rotating bed, with a hoist line extending therefrom; a mast mounted at its first end on the rotating bed and having a second end opposite the first end; the method comprising:

a) transporting the mast to a job site separately from the rotating bed, moving the mast from a position in which it is not connected to the rotating bed to a position where it can be connected to the rotating bed, connecting the mast to the rotating bed and positioning the mast in a first position so that it extends rearwardly over the rotating bed;

b) utilizing a linear actuation device also connected to the rotating bed to pivotally rotate the mast from its first position about its connection to the rotating bed, thereby raising the second end of the mast to a second position where the mast is used during crane pick, move and set operations; and c) further connecting the mast in its second position to the rotating bed so as to provide the mast with a fixed angle compared to the plane of rotation of the rotating bed when the angle of the boom compared to the plane of rotation of the rotating bed changes during crane pick, move and set operations, wherein the mast connection to the rotating bed in its second position is made after the second end of the mast is raised to the second position.

2. The method of claim 1 wherein the linear actuation device is provided as part of a counterweight movement structure connected between the rotating bed and a moveable counterweight when the crane is set up.

3. The method of claim 2 further comprising connecting a pivot frame between the rotating bed and the linear actuation device, and connecting a rear arm between the pivot frame and the counterweight unit, and wherein the linear actuation device causes the rear arm to move the counterweight unit when the linear actuation device is retracted and extended when the crane is in an operational configuration.

4. The method of claim 1 wherein a roller is supported by the linear actuation device and contacts the mast, and the roller rotates against an underside surface of the mast as the mast is raised.

5. The method of claim 1 further including pivotally connecting at least one arm at a first end to the rotating bed and at a second end to the linear actuation device, and wherein the linear actuation device causes the arm to pivot when the linear actuation device is retracted and extended.

6. The method of claim 1 wherein the linear actuation device comprises at least one hydraulic cylinder.

7. The method of claim 1 wherein the linear actuation device is pinned to the mast when it is used to raise the mast.

8. A method of setting up a mobile lift crane, comprising:

a) providing a carbody having moveable ground engaging members, a rotating bed rotatably connected to the carbody such that the rotating bed can swing with respect to the ground engaging members, a boom that can be pivotally mounted on a front portion of the rotating bed, and at least one linear actuation device;

b) pivotably securing a mast at a first end thereof to the rotating bed;

c) pivotably securing a backhitch to the mast at a position distant to the first end of the mast;

d) using the linear actuation device to rotate the mast so as to lift the mast and simultaneously raise the backhitch; and e) connecting the backhitch to the rotating bed so as to support the mast in a fixed, upright position during crane pick, move and set operations during which the angle of the boom compared to the plane of rotation of the rotating bed changes.

9. The method of claim 8 further comprising pivotally connecting at least one arm at a first end to the rotating bed and wherein the linear actuation device is connected at a first end to the rotating bed and at a second end to the pivoting arm, and wherein the linear actuation device causes the arm to pivot when the linear actuation device is retracted and extended.

10. The method of claim 9 wherein the at least one arm comprises a pivot frame, and the pivot frame is provided so as to be connected between the rotating bed and the linear actuation device.

11. The method of claim 8 wherein a mast-engaging member is supported by the linear actuation device, with the mast-engaging member contacting the mast when the linear actuation device is raising the mast.

12. The method of claim 11 wherein the mast-engaging member is provided with a roller.

13. The method of claim 8 further comprising using the linear actuation device to raise the mast from its initial connected position to a position where the mast is used during crane pick, move and set operations.

14. The method of claim 8 wherein the linear actuation device comprises at least one hydraulic cylinder.

15. The method of claim 8 wherein the linear actuation device is pinned to the mast when it is used to raise the mast.

16. A mobile lift crane comprising:

a) a carbody having moveable ground engaging members;

b) a rotating bed rotatably connected to the carbody such that the rotating bed can swing with respect to the ground engaging members;

c) a boom pivotally mounted on a front portion of the rotating bed;

d) a mast mounted at its first end on the rotating bed and having a second end, and a backhitch, the backhitch also being connected to the rotating bed and adjacent the second end of the mast so as to secure the mast to the rotating bed at a fixed angle compared to the plane of rotation of the rotating bed during crane pick, move and set operations during which the angle of the boom compared to the plane of rotation of the rotating bed changes; and e) at least one linear actuation device pivotally connected at a first end to the rotating bed; the linear actuation device being positioned and configured so as to be able to raise the second end of the mast from the mast being in a near horizontal position to a position where the mast is used during crane pick, move and set operations.

17. The mobile lift crane of claim 16 wherein the linear actuation device comprises at least one hydraulic cylinder and the crane further comprises at least one arm pivotally connected to the rotating bed at a first end and to the hydraulic cylinder at a second end, the arm and hydraulic cylinder being connected together such that extension and retraction of a piston within the hydraulic cylinder causes the second end of the arm to raise and lower, the arm and cylinder further supporting at least one mast-engaging member positioned such that raising the second end of the arm causes the mast-engaging member to push against and raise the mast when the mast is in a set-up state.

18. The mobile lift crane of claim 17 wherein the at least one arm comprises a pivot frame, the pivot frame connected between the rotating bed and hydraulic cylinder.

19. The mobile lift crane of claim 17 wherein the mast-engaging member comprises at least one roller.

20. The mobile lift crane of claim 16 wherein the backhitch is connected to the rotating bed at a point forward of its connection to the mast.

21. The mobile lift crane of claim 16 further comprising a counterweight unit and a tension member connected adjacent the top of the mast supporting the counterweight unit.

22. The mobile lift crane of claim 21 wherein the linear actuation device is part of a counterweight movement structure connected between the rotating bed and the counterweight unit such that the counterweight unit may be moved to and held at a first position in front of the top of the mast and moved to and held at a second position rearward of the top of the mast.

23. The mobile lift crane of claim 16 wherein the linear actuation device comprises at least one hydraulic cylinder.

24. The mobile lift crane of claim 16 wherein the linear actuation device is configured so that it can be pinned to the mast when it is used to raise the mast.

25. A mobile lift crane comprising:

a) a carbody having moveable ground engaging members;

b) a rotating bed rotatably connected to the carbody such that the rotating bed can swing with respect to the ground engaging members about an axis of rotation;

c) a boom pivotally mounted on a front portion of the rotating bed;

d) a mast mounted at its first end on the rotating bed and adjacent a second end to a backhitch, the backhitch also being connected to the rotating bed so as to secure the mast to the rotating bed at a fixed angle compared to the plane of rotation of the rotating bed during crane pick, move and set operations during which the angle of the boom compared to the plane of rotation of the rotating bed changes;

e) a moveable counterweight unit suspended from a tension member connected adjacent a second end of the mast; and f) a counterweight movement structure connected between the rotating bed and the counterweight unit such that the counterweight unit may be moved away from and toward the front portion of the rotating bed while a load is attached to a hoist line suspended from the boom, the counterweight movement structure comprising at least one arm pivotally connected to the rotating bed at a first end and having a second end, the counterweight movement structure further supporting at least one mast-engaging member positioned such that raising the second end of the arm causes the mast-engaging member to push against and raise the mast when the mast is in a set-up state.

26. The mobile lift crane of claim 25 wherein the counterweight movement structure can move the counterweight over a distance of at least 10 meters.

27. The mobile lift crane of claim 25 wherein the at least one rear arm comprises a rear arm and a pivot frame, and wherein the rear arm has a bent configuration so that it can be connected in line with an outer member of the pivot frame without interfering with the pivot frame when the counterweight is in a far forward position.

* * * * *